US011028347B2

(12) United States Patent
Piorkowski et al.

(10) Patent No.: US 11,028,347 B2
(45) Date of Patent: Jun. 8, 2021

(54) STABLE UNIT DOSE DETERGENT PACS

(71) Applicant: Henkel IP & Holding GmbH, Duesseldorf (DE)

(72) Inventors: Daniel Thomas Piorkowski, Fairfield, CT (US); Casey Elphege Camire, Shelton, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 49 days.

(21) Appl. No.: 15/880,682

(22) Filed: Jan. 26, 2018

(65) Prior Publication Data

US 2019/0233768 A1 Aug. 1, 2019

(51) Int. Cl.

| | |
|---|---|
| ***C11D 17/04*** | (2006.01) |
| ***C11D 1/83*** | (2006.01) |
| ***C11D 1/29*** | (2006.01) |
| ***C11D 1/72*** | (2006.01) |
| ***C11D 3/20*** | (2006.01) |
| ***C11D 3/43*** | (2006.01) |

(52) U.S. Cl.

CPC ..... *C11D 3/43* (2013.01); *C11D 1/83* (2013.01); *C11D 17/043* (2013.01); *C11D 1/29* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 5,880,076 | A * | 3/1999 | Vermeer | A61K 8/42 510/119 |
| 2004/0192569 | A1* | 9/2004 | Colurciello | C11D 1/835 510/296 |
| 2011/0209291 | A1* | 9/2011 | Sadlowski | C11D 1/002 8/137 |
| 2012/0232170 | A1* | 9/2012 | Klinkhammer | C11D 3/2068 514/789 |
| 2013/0065811 | A1* | 3/2013 | Fernandez-Prieto | C11D 3/32 510/375 |
| 2013/0206638 | A1* | 8/2013 | Wong | C11D 3/046 206/524.7 |
| 2014/0274859 | A1* | 9/2014 | Adamy | C11D 1/02 510/296 |
| 2015/0252301 | A1* | 9/2015 | Gibis | C11D 17/0008 510/109 |
| 2015/0291944 | A1* | 10/2015 | Graycar | C11D 3/38627 435/198 |
| 2015/0329807 | A1* | 11/2015 | Naqvi | C11D 3/2041 206/524.7 |
| 2015/0344858 | A1* | 12/2015 | Barnett | C12N 9/2494 435/99 |
| 2017/0015958 | A1* | 1/2017 | Rodrigues | C11D 3/2041 |
| 2017/0029747 | A1* | 2/2017 | Depoot | C11D 3/222 |
| 2018/0155658 | A1* | 6/2018 | Lant | C11D 3/0068 |

FOREIGN PATENT DOCUMENTS

| | | | |
|---|---|---|---|
| EP | 2865741 | A1 | 4/2015 |
| EP | 3476925 | A1 | 5/2019 |
| GB | 2376238 | A | 12/2002 |
| GB | 2392450 | A | 3/2004 |

OTHER PUBLICATIONS

European Search Report EP 18208798 Completed: Jun. 24, 2019 dated Jul. 2, 2019 6 pages.

* cited by examiner

*Primary Examiner* — Lorna M Douyon

(74) *Attorney, Agent, or Firm* — Bojuan Deng

(57) ABSTRACT

Stable unit dose detergent pacs are provided which are less prone to leakage or breakage and more aesthetically pleasing during handling. The unit dose pacs include a water-soluble container formed from a water-soluble or water-dispersible film and a wash composition encapsulated in the container. According to one embodiment, the wash composition includes an anionic surfactant present at from about 2% to about 35%, a non-ionic surfactant present at from about 2% to about 30%, and a solvent system present at from about 37.5% to about 80%, characterized in that the solvent system is composed of water and a single non-aqueous solvent only, or composed of water, a single non-aqueous solvent, and a residual solvent (less than 5%) only.

20 Claims, No Drawings

STABLE UNIT DOSE DETERGENT PACS

TECHNICAL FIELD

This invention is in the fields of household and industrial cleaning. More particularly, the invention relates to stable unit dose detergent pacs with solvent loadings that are higher than typical yet maintain pac rigidity.

BACKGROUND OF THE INVENTION

Detergent packaged in unit dose pacs (or packs) is available for a variety of washing activities, such as clothes laundering and dish washing. Unit dose pacs, which are also called single dose pacs, provide a pre-measured quantity of detergent that is easy to carry and convenient to use. Many single dose pacs include a wash composition encapsulated in a water-soluble film made from polyvinyl alcohol or polyvinyl acetate, where the wash composition may include detergent and other components useful for cleaning. Unit dose pacs minimize over-dosage of detergent and avoid skin contact with potentially irritating cleaning compositions, and have proven popular with consumers.

Various types of unit dose pacs are available depending on the form of the wash composition, which may be tablet, liquid, granule, paste, or gel. Of these forms, liquid form is preferred to some consumers because of its aesthetic appearance and quicker delivery and dispersibility of detergent in a wash liquor, especially in a cool or cold water washing process. Unit dose detergent pacs in liquid form require the use of a balanced water and non-aqueous solvent system to keep the wash composition be in a solution. Most commonly used solvent system includes three solvents: water, glycerin, and propylene glycol. High solvent content is desirable to ensure unit dose detergent products substantially free of efflorescence. Efflorescence is a phenomenon when solvated salts precipitate out, on, or in the film. Any sign of efflorescence of unit dose pacs may be perceived as product deterioration.

However, in unit dose formulations with high solvent content, e.g., over 30% wt of total added solvent, instabilities in the wash composition (e.g., phase separation) may be observed. Moreover, such unit dose products may be difficult to maintain pac rigidity. With increased solvent content, the weight of the liquid composition in the unit dose pacs makes the film 'sag' down, resulting in the unit dose pacs appearing 'floppy'. Such unit dose pacs may suffer from unexpected rupturing due to the weight of one compartment putting undue load pressure on the film causing it to overstretch.

There remains a need in the art for a unit dose composition with high solvent content while maintaining pac integrity such as rigidity and stability.

Accordingly, it is desirable to provide unit dose pacs with increased solvent loading where the film remains structurally sound for extended periods. In addition, it is desirable to provide single dose pacs with non-aqueous solvents that mitigate the water solubility of an encapsulating film, and methods of producing the same. Other desirable features and characteristics will become apparent from the subsequent Detailed Description and the appended claims, taken in conjunction with the foregoing Technical Field and Background of the Invention.

SUMMARY OF THE INVENTION

The present invention is based on the discovery of a solvent system consisting of water, a single non-aqueous solvent (NAS), and a residual solvent (from 0 to 5% wt), which, when used in a unit dose pac, not only stabilizes the detergent composition inside the unit dose pac but also enhances pac rigidity to an acceptable level despite the much higher solvent content. None of the NAS or the residual solvent needs to be the conventional solvents (i.e., glycerin and propylene glycol) for unit dose pacs. Overall benefit to the consumer is providing more stable unit dose pacs which are less prone to leakage or breakage and more aesthetically pleasing during handling, and have a good dissolution profile. The advantages of the unit dose pacs may be exhibited by its ability to maintain pac height, pac weight, and dissolution properties after storage for a period of time.

According to one aspect of the present invention, a unit dose pac is provided. The unit dose pac comprises: (a) a container formed from a water-soluble or water-dispersible film material; and (b) a liquid composition; wherein the water-soluble or water-dispersible film forms a container that entraps the liquid composition. The liquid composition comprises: (i) a beneficial composition; and (ii) a solvent system consisting of water and a single non-aqueous solvent, and optionally a residual solvent (less than 5% wt) from the beneficial composition which is neither water nor the single non-aqueous solvent.

Each of water and the non-aqueous solvent is present in an amount of greater than 5% by weight of the liquid composition. Overall, the solvent system totals from about 37.5% to about 80%. In one preferred embodiment, the solvent system totals from about 40% to about 65%, by weight of the liquid composition.

In some embodiments, the NAS may be selected from a group consisting of polyols, ionic liquids, polyglycol ethers, EO/PO block copolymers, polyethylene glycols, and mixtures thereof. In other embodiments, suitable NAS for the invention may be selected from polyethylene glycol (PEG); polypropylene glycol (PPG); polyethylene glycol esters such as polyethylene glycol stearate, polyethylene glycol laurate, and/or polyethylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3-propanediol; xylitol; mannitol; erythritol; dulcitol; inositol; adonitol; triethylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers; wherein the single non-aqueous solvent has a weight average molecular weight of 4000 Daltons or less.

In some embodiments, the NAS may be PEG, PPG, an ester of PEG, or an ester of PPG. In some embodiments, the NAS is PEG having a number average molecular weight of from about 100 to about 4000 Daltons; preferably, PEG 400 or PEG 3350.

In some embodiments, the NAS is PEG 100 stearate.

In some embodiments, the NAS is neither glycerin nor propylene glycol. In other embodiments, the residual solvent is neither glycerin nor propylene glycol. In further embodiments, the liquid composition contains no glycerin or propylene glycol.

In some embodiments, water is present in an amount of from about 5% to about 45%. In one preferred embodiment, water is present in an amount of from about 20% to about 25%, by weight of the liquid composition.

In some embodiments, the NAS is present in an amount of from about 10% to about 70%. In one preferred embodiment, water is present in an amount of from about 25% to about 30%, by weight of the liquid composition.

In other embodiments, the residual solvent is ethanol in an amount of about 3% by weight of the liquid composition.

The beneficial composition may include a surfactant system, a fragrance, a color care agent, a softening agent, an optical brightener, an enzyme, a defoamer, or a combination thereof.

The surfactant system may be an anionic surfactant, a nonionic surfactant, a cationic surfactant, an ampholytic surfactant, a zwitterionic surfactant, or a mixture thereof in an amount from about 10 wt % to about 65 wt % of one or more surfactants, preferably from about 15 wt % to about 60 wt %, more preferably from about 20 wt % to about 55 wt %, more preferably from about 30 wt % to about 50 wt %, and most preferably from about 40 wt % by weight of the liquid composition.

In some embodiments, the surfactant system consists of an anionic surfactant and a nonionic surfactant.

Suitable nonionic surfactants may be selected from the group consisting of polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, and a mixture thereof.

Suitable anionic surfactant may be selected from a group consisting of a linear alkylbenzene sulfonic acid or a salt thereof, alkyl ethoxylated sulphate, alkyl propoxy sulphate, alkyl sulphate, and a mixture thereof.

In preferred embodiments, the nonionic surfactant is an alcohol ethoxylate, such as C12-C15 Alcohol Ethoxylate 7EO, and the anionic surfactant is an alcohol ethoxylsulfate, such as sodium lauryl ether sulphate (3EO).

In more preferred embodiments, the alcohol ethoxylsulfate and the alcohol ethoxylate are present in an amount of from about 30% to about 50% by weight of the liquid composition.

In some embodiments, the alcohol ethoxylsulfate and the alcohol ethoxylate are present in a weight ratio of from about 1:1 to about 1:5, preferably in a weight ratio of about 1:1.5.

In some embodiments, the water-soluble or water-dispersible film material is selected from the group consisting of polyvinyl alcohol (PVOH), polyvinyl acetate (PVA), film forming cellulosic polymer, polyacrylic acid, polyacrylamide, polyanhydride, polysaccharide, polyvinyl pyrrolidone, polyalkylene oxide, cellulose, cellulose ether, cellulose ester, cellulose amide, polyvinyl acetate, polycarboxylic acid and salt, polyaminoacid, polyamide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, and hydroxypropyl methyl cellulose (HPMC), or a mixture thereof.

In some embodiments, the water-soluble or water-dispersible film material is polyvinyl alcohol (PVOH) or polyvinyl acetate (PVA).

In some embodiments, the water-soluble or water-dispersible film material is between about 50 to about 120 microns thick, preferably about 60 to about 100 microns.

DETAILED DESCRIPTION OF THE INVENTION

The following detailed description is merely exemplary in nature and is not intended to limit the single dose pac, or the method for producing or using the same. Furthermore, there is no intention to be bound by any theory presented in the preceding Background or the following Detailed Description.

As used herein, "a," "an," or "the" means one or more unless otherwise specified. However, the term "single" means one.

The term "or" can be conjunctive or disjunctive.

Open terms such as "include," "including," "contain," "containing" and the like mean "comprising."

As used herein, the terms "container", "pouch", "pack", "pac", "unit dose", and "single dose" can be used interchangeably and can have one or two or multi-compartment (i.e., multi-chamber).

As used herein, the term "stable" means that the pac maintains its rigidity and film integrity without breakage and/or leakage.

The terms "blend(s)" and "composition(s)" are used interchangeably.

As used herein, the terms "solvent," "solvents," and "solvent system," mean a liquid or liquids used to dissolve or solvate other chemicals. In other cases, a solvent (i.e., solvent A) can initially exist as a solid and then be dissolved within solvent B, so solvent A can then act as a solvent itself (i.e., PEG 3350 in water). As used herein, the terms "solvent," "solvents," and "solvent system," do not include neutralization agents, such as, e.g., triethanolamine, monoethanolamine, sodium hydroxide, and acids.

A term in a singular or plural form can mean both singular and plural forms. For example, "textile" or "textiles" may mean both textiles and textile; and "encapsulate" or "encapsulates" may mean both encapsulate and encapsulates.

As used herein, the term "about" includes the recited number ±10%. For example, "about 10" means 9 to 11.

As used herein, the phrase "substantially free of" means that a composition contains little no specified ingredient/component, such as less than about 5%, 4%, 3%, 2%, 1%, 0.5%, or 0.1%, or below the detectable level of the specified ingredient. For example, the phrase "substantially free of a sulphate surfactant" refers to a liquid composition of the present disclosure that contains little or no sulphate surfactant.

As used herein, "%" described in the present disclosure refers to the weight percent unless otherwise indicated.

Unless stated otherwise, molecular weight of a polymer refers to weight average molecular weight. When a number follows a chemical name, such as PEG 400, the number 400 indicates the average molecular weight of PEG.

The term "mono-alcohol" or "mono-ol" refers to a compound having only one hydroxyl group and having no other functional groups. The term "di-alcohol" or "diol" refers to a compound having two hydroxyl groups and having no other functional groups, unless otherwise stated. The term "polyol" refers to a compound having two or more hydroxyl groups and having no other functional groups, unless otherwise stated.

A term beginning with "poly" means that a polymer has 4 or more carbons in the main carbon chain. For example, polypropylene glycol has 4 or more carbons in the main carbon chain, which can also be described as a 4C+ compound. In contrast, propylene glycol has 3 carbon atoms in the molecular chain.

Unit Dose Pac—Container

In one aspect, the present disclosure provides a unit dose composition comprising a container and a liquid composition. The container may be a pouch or a pack (or pac) that comprises a water-soluble or water-dispersible film, which fully encloses the liquid composition in at least one compartment. In some embodiments, the pouch or the pac comprises two compartments. The unit dose composition is suitable for cleaning fabrics or dishes, or providing fabric care benefits or sensorial benefits (such as a fragrance booster, softening, malodor control, whitening, and color protection) to fabrics.

The water-soluble or water-dispersible container of the present invention may be in any desirable shape and size, e.g., square, rectangular, oval, elliptoid, superelliptical, or circular shape.

The container of the unit dose is formed from a water-soluble or water-dispersible polymer film. Non-limiting examples of water-soluble or water-dispersible polymers suitable for preparing the container of the present invention include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycol, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, film forming cellulosic polymer, polyanhydride, polysaccharide, polyalkylene oxide, cellulose, cellulose ester, cellulose amide, polyvinyl acetate, polycarboxylic acid and salt, polyaminoacid, polyamide, natural gums, polyacrylate, water-soluble acrylate copolymer, methylcellulose, carboxymethylcellulose sodium, dextrin, ethylcellulose, maltodextrin, polymethacrylate, polyvinyl alcohol copolymer, and mixtures thereof.

In some embodiments, the water-soluble or water-dispersible film material of the container may be polyvinyl alcohol, polyvinyl acetate, film forming cellulosic polymer, polyacrylic acid, polyacrylamide, polyanhydride, polysaccharide, or a mixture thereof. In preferred embodiments, the water-soluble or water-dispersible film material is polyvinyl alcohol or polyvinyl acetate. In a more preferred embodiment, the water-soluble or water-dispersible container is made from a lower molecular weight water-soluble polyvinyl alcohol film-forming resin.

Suitable PVOH films are sold under the trade name MONOSOL® (e.g., Monosol film M8630, Monosol film M8720, Monosol film M8312, available from MonoSol LLC, Merrillville, Indiana). The preferred grade is MONOSOL® film having a weight average molecular weight range of about 55,000 to 65,000 and a number average molecular weight range of about 27,000 to 33,000. Other suitable PVOH film forming resins include those sold under trade name Solublon®, available from Aicello Corporation (e.g., Solublon® PT75, Aiichi, Japan; North American subsidiary in North Vancouver, BC, Canada).

In some embodiments, the water-soluble or water-dispersible container may further contain a cross-linking agent. In one embodiment, the cross-linking agent is boric acid or sodium borate.

In some embodiments, the water-soluble or water-dispersible container can have a protective layer between the film polymer and the composition in the container. In some embodiments, the protective layer may comprise polytetrafluoroethylene (PTFE).

The film material on the container may have a thickness of between about 50 to about 120 microns, preferably about 60 to about 100 microns.

The water-soluble or water-dispersible container of the present invention may be prepared in any suitable way, such as via molding, casting, extruding or blowing, and is then filled using an automated filling process, as known in the prior art.

Unit Dose Pac—Liquid Composition

A liquid composition is encapsulated in a container made of a water-soluble or water-dispersible film. The solubility of the film in water should be moderated to keep the film structurally sound prior to use. It has been found that the inclusion of a single non-aqueous solvent of certain type in the liquid composition moderates the solubility of the film, thereby protecting the film from being dissolved by water incorporated in the liquid composition. As such, adding the non-aqueous solvent to the wash composition allows for unit dose pacs where the liquid composition therein includes water present in amounts of up to about 45%, by the weight of the liquid composition. It also allows for unit dose pacs where the liquid composition therein includes contain a high total solvent content, up to about 80%, by the weight of the liquid composition without compromising pac rigidity.

According to one aspect of the invention, the liquid composition comprises: (i) a beneficial composition; and (ii) a solvent system consisting of water and a single non-aqueous solvent (NAS), and a residual solvent present in an amount of 0 to 5% by weight of the liquid composition. The residual solvent is neither water nor the single NAS. Each of water and the NAS is present in an amount of greater than 5% by weight of the liquid composition. The solvent system totals from about 37.5% to about 80% by weight of the liquid composition.

For clarity, the term "beneficial composition", as used herein, is limited to components (such as a surfactant system, a fragrance, a color care agent, a softening agent, an optical brightener, an enzyme, a defoamer) which perform certain functions and are commonly used in a finished detergent product. However, the term "beneficial composition", as used herein, does not include a solvent nor does it serve a solvent function. Should any component of the beneficial composition (e.g., a surfactant system, a fragrance, a color care agent, a softening agent, an optical brightener, an enzyme, a defoamer) is provided with a solvent (e.g., water, a non-aqueous solvent), as found in some commercial products, such solvent will be counted as part of the solvent system. In other words, any water or a NAS solvent that comes with a component of a beneficial composition, together with water or the NAS solvent freshly added to the liquid composition, will be considered part of the solvent system. Thus, to prepare a composition with a set amount of water in the solvent system, the more water provided with the components in the beneficial composition, the less water is required to be added to the liquid composition. The term "residual solvent" refers to a solvent that is provided with a component of the beneficial composition, which is neither water or the NDA, and which is present in an amount of from 0 to 5% by weight of the liquid composition.

In some embodiments, the solvent system comprises from about 37.5% to about 70%, preferably from about 40% to about 65%, and more preferably from about 50% to about 60%, based on the total weight of the liquid composition. In other embodiment, the solvent system is present in an amount of from 37.5% to about 40%, from about 40% to about 45%, from about 45% to about 50%, from about 50% to about 55%, from about 55% to about 60%, from about 60% to about 65%, from about 65% to about 70%, from about 70% to about 75%, or from about 75% to about 80%, by weight of the liquid composition.

Non-Aqueous Solvent

Only one single NAS which is greater than 5% wt is present in the liquid composition. In some embodiments, the NAS is present from about 10% to about 70%, preferably from about 20% to about 65%, more preferably from about 25% to about 60%, more preferably from about 30% to about 55%, and most preferably from about 40% to about 55%, based on the total weight of the liquid composition.

In other embodiments, the NAS is present in an amount of from about 10% to about 20%, from 20% to about 30%, from about 30% to about 40%, from about 40% to about 50%, from about 50% to about 60%, from about 60% to about 70%, by weight of the liquid composition.

In preferred embodiments, the NAS is present in an amount of about 25%, from 22% to about 27%, from 28% to about 35%, from about 33% to about 43%, or from about 40% to about 45%, by weight of the liquid composition.

In some embodiments, the NAS may be chosen from polyethylene glycol; polypropylene glycol; polypropylene glycol esters; polyethylene glycol esters such as polyethylene glycol stearate, polyethylene glycol laurate, and/or polyethylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl-1,3-propanediol; xylitol; mannitol; erythritol; dulcitol; inositol; adonitol; triethylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl) methyl ammonium methylsulfate; ethylene oxide/propylene oxide copolymers with the single non-aqueous solvent has a weight average molecular weight of 4000 Daltons or less.

In preferred embodiments, the NAS is selected from polyethylene glycol; polyethylene glycol esters such as polyethylene glycol stearate, polyethylene glycol laurate, and/or polyethylene glycol palmitate; polyproylene glycol.

In some embodiments, the NAS is polyethylene glycol ("PEG") and an ester thereof. The PEG can have a weight average molecular weight ranging, for example, from about 100 to about 4000 Daltons. Suitable PEGs can have a weight average molecular weight of, for example, about 300, about 400, about 500, about 600, about 700, about 800, about 900, about 1000, about 1100, about 1200, about 1300, about 1400, about 1500, about 1600, about 1700, about 1800, about 1900, about 2000, about 2100, about 2200, about 2300, about 2400, about 2500, or about 2600, about 2700, about 2800, about 2900, about 3000, about 3500, or about 4000 Daltons.

In some preferred embodiments, the NAS is PEG 100 stearate, PEG 400, or PEG 3350. In an even more preferred embodiment, the NAS is PEG 400 in an amount of from about 20% to about 45% by weight of the liquid composition; while water is present in an amount of from about 10% to about 30% by weight of the liquid composition.

Water

Water in the liquid composition may be derived from added water or water accompany a component that forms the beneficial composition. The total water amount presented in the liquid composition is from about 5% to about 45%, preferably from about 10% to about 40%, more preferably from about 15% to about 35%, more preferably from about 20% to about 40%, even more preferably from about 25% to about 35%, and most preferably from about 25% to about 30%, based on the total weight of the liquid composition.

In other embodiment, water is present in an amount of from about 5% to about 10%, from 10% to about 15%, from about 15% to about 20%, from about 20% to about 25%, from about 25% to about 30%, from 30% to about 35%, from about 35% to about 40%, or from about 40% to about 45%, by weight of the liquid composition.

In preferred embodiments, water is present in an amount of from 11% to about 16%, from 17% to about 23%, or from about 22% to about 32%, by weight of the liquid composition.

In some embodiments, the weight ratio of water to the NAS is from 1:4 to 4:1, from 1:3 to 3:1, from 1:3 to 2:1, from 1:2 to 2:1, or about 1:1. In other embodiments, the weight ratio of water to the NAS is from 1:1 to 4:1, from 1:1 to 3:1, or from 1:1 to 2:1. In further embodiments, the weight ratio of water to the NAS is about 0.5:1, about 0.8:1, about 1:1, about 1:1, about 1.2:1, about 1.3:1, or about 1.5:1.

Residual Solvent(s)

The term "residual solvent(s)" generally refer to a solvent that is introduced into the liquid composition by the addition of an ingredient (i.e., a commercial product containing the ingredient and the residual solvent), where the residual solvent is less than 5% by weight of the liquid composition. In some embodiments, the residual solvent is less than 5% wt, preferably less than 3% wt, and more preferably less than 1% wt.

The residual solvent is neither water or the NAS. In some embodiments, the residual solvent is a mono-ol or di-ol with a low Mw. For example, the residual solvent may be ethanol. The existence of the residual solvent does not interfere with the performances of the solvent system.

Testing has been conducted to compare pac length, pac height, dissolution rate, and weight loss of unit dose pacs prepared with the inventive liquid compositions verses unit dose pacs prepared with conventional liquid compositions. It is known that single dose pacs tend to 'sag' down and appear 'floppy' during storage. They may even lose weight due to loss of solvents.

Percent pac height loss or percent pac length increase is a good indication of the haptics of the pac. Percent pac height loss is a ratio of a change in pac height (original pac height minus a final pac height after storage) to the original pac height. Percent pac length increase is a ratio of a change in pac length (a final pac length after storage minus original pac length) to the original pac length. A direct comparison between two types of pacs can be easily performed by comparing their pac lengths and pac heights. A more rigid and stable unit dose pac would have a smaller pac length and a bigger pac height compared to a less stable unit dose pac. Generally, a smaller pac length is preferred since it relates to the tautness of the pac. The smaller this length is, the less plasticized the pac has become from solvents and other materials.

Percent weight loss of a pac is a ratio of a change in pac weight (original pac weight minus a final pac weight after storage) to the original pac weight. Single dose pacs tend to lose some weight with storage, and the percent pac weight loss is a good indication of the stability of the pac. A single dose pac with a low percent pac weight loss has a more appealing appearance to a user, where a package with several single dose pac looks fuller and each single dose pac appears fresher and more appealing.

Testing methods and results will be disclosed in the Examples section of the present application. Testing results show that the solvent system as described herein has a significant effect on the pac integrity. The solvent system not only stabilizes the detergent composition inside the unit dose pac but also enhances pac rigidity to an acceptable level. As such, the pac film can remain structurally sound during storage for an extended period of time period. Structurally sound means that unit dose pacs do not 'sag' down and appear 'floppy'. It also means that the film is not tacky or sticky to the touch.

Beneficial Composition

The liquid composition comprises a beneficial composition. As used herein, the term "beneficial composition" means a surfactant system, a fragrance, a color care agent, a softening agent, an optical brightener, an enzyme, a defoamer, or other functional (non-solvent function) materials commonly used in a detergent product.

For unit dose pacs to deliver detergent, the beneficial composition necessarily includes a surfactant system, which may comprise an anionic surfactant, a nonionic surfactant, a cationic surfactant, an ampholytic surfactant, a zwitterionic surfactant, or a mixture thereof.

The surfactant system may be present in an amount from about 10% to about 65% of one or more surfactants, preferably from about 15% to about 60%, more preferably from about 20% to about 55%, more preferably from about 30% to about 50%, and most preferably from about 40% by weight of the liquid composition.

In a preferred embodiment, the unit dose detergent pacs of the present invention have a surfactant system consisting of an anionic surfactant and a nonionic surfactant. For example, the unit dose detergent pacs of the present invention may have a liquid composition comprises, by weight of the liquid composition:

(1) a beneficial component comprising:

(i) an anionic surfactant selected from an alkyl ethoxylated sulphate (AES), an alkyl propoxy sulphate, an alkyl sulphate, a linear alkylbenzene sulfonic acid (LAS) or a salt thereof, or a mixture thereof; and preferably, selected from alkyl ethoxylated sulphate, in an amount of from about 2% to about 35% by weight of the liquid composition.

(ii) a non-ionic surfactant selected from alcohol ethoxylate, alcohol propoxylate, or a mixture thereof, in an amount of from about 2% to about 30% by weight of the liquid composition.

(2) a solvent system consisting of water and a single non-aqueous solvent, and a residual solvent in an amount of less than 5% by weight of the liquid composition, wherein the residual solvent is neither water nor the single non-aqueous solvent;

wherein each of water and the single non-aqueous solvent is present in an amount of greater than 5% by weight of the liquid composition; and wherein the solvent system totals from about 37.5% to about 80% by weight of the liquid composition.

(a) Nonionic Surfactants

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

Alcohol Ethoxylate (AE)

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (I):

$$R_2—(—O—C_2H_4—)_m—OH \quad (I)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® C200 (available from Clariant), which is a coco alcohol having an average degree of ethoxylation of 20.

In some embodiments, the amount of non-ionic surfactant (s) is selected so as to form a structured surfactant system together with other types of surfactants. In some embodiments, the liquid composition comprises about 2% to about 30% of a non-ionic surfactant, based on the weight of the liquid composition. In other embodiments, the liquid composition contains from about 2% to about 3%, from 3% to about 5%, from 3% to about 8%, from about 5% to about 10%, from 10% to about 15%, from 15% to about 20%, from about 20% to about 23%, from 20% to about 25%, or from 25% to about 30% of the non-ionic surfactant(s), based on the weight the liquid formulation.

(b) Anionic Surfactants

In some embodiments, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates. One example of AES is sodium laureth ether sulfate (SLES).

In other embodiments, the anionic surfactant may be linear alkylbenzene sulfonic acid (LAS) or a salt thereof, alkyl ethoxylated sulphate, alkyl propoxy sulphate, alkyl sulphate, or a mixture thereof.

Alcohol Ethoxylsulfate (AES)

Alcohol ethoxysulfate, also known as alkyl ether sulfates or alkyl polyethoxylate sulfates, are compounds having Formula (II):

$$R_1—O—(C_2H_4O)_n—SO_3M \quad (II)$$

wherein $R_1$ is a $C_8$-$C_{22}$ alkyl group, n is from 1 to 20, and M is a salt-forming cation. Preferably, $R_1$ is a $C_{10}$-$C_{18}$ alkyl, a $C_{10}$-$C_{15}$ alkyl, a $C_{12}$-$C_{18}$ alkyl, or a $C_{12}$-$C_{16}$ alkyl; n represents 1 to 15, 1 to 10, 1 to 8, 1 to 5, 2 to 9, 2 to 5, 1 to 3, 3 to 5, 5 to 8, or 8 to 10; and M is sodium, potassium, ammonium, alkylammonium, or alkanolammonium. More preferably, $R_1$ is a $C_{12}$-$C_{16}$ alkyl, n represents 2-5, and M is sodium. In a preferred embodiment, the AES is $CH_3(CH_2)_{12-14}CH_2O(CH_2CH_2O)_3SO_3Na$. In some embodiments, an aqueous AES solution with 60% of $CH_3(CH_2)_{12-14}CH_2O(CH_2CH_2O)_3SO_3Na$ (also called the active) is used. One or more AES may be concurrently used in the liquid formulation.

One AES compound widely used in many laundry detergent products and personal care products is sodium laureth ether sulfate (SLES), also known as sodium lauryl ether sulfate. Its chemical formula is $CH_3(CH_2)_{11}(OCH_2CH_2)_nOSO_3M$, wherein n may be 2 or 3. Commercial SLES typically has three ethoxyl groups (i.e., n=3) in the chemical formula; and M is sodium, potassium, ammonium, alkylammonium, or alkanolammonium.

Linear Alkylbenzene Sulfonic acid (LAS)

Linear alkylbenzene sulfonate is a water-soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

The amount of the anionic surfactant(s) in the liquid formulation of the present disclosure is selected so as to form a structured surfactant system together with other types of surfactants. In some embodiments, the liquid composition contains from about 2% to about 35% of the anionic surfactant(s). In other embodiments, the liquid composition contains from about 3% to about 5%, from 3% to about 8%, from 5% to about 10%, from about 10% to about 15%, from 15% to about 20%, from 20% to about 25%, from about 23% to about 28%, from 23% to about 26%, or from 25% to about 28% of the anionic surfactant(s), based on the weight the liquid formulation.

In some of these embodiments, the liquid compositions are substantially free of LAS. In some of these embodiments, the anionic surfactant of the liquid composition contains only AES.

In some embodiments, the component (a) (i.e., anionic surfactant(s), such as AES) and the component (b) (i.e., nonionic surfactant(s), such as EA) are present in a weight ratio of from about 1:4 to about 4:1, from about 1:3 to about 3:1, from about 1:2 to about 2:1, or from about 1:1 to about 1:1.7. In preferred embodiments, the ratio is from about 1:1 to about 1:1.7.

Optionally, other ingredients may be added in the liquid composition. As discussed earlier, the detergent composition may comprise a cationic surfactant, an ampholytic surfactant, a zwitterionic surfactant, or mixtures thereof.

(c) Non-Surfactant Beneficial Components

The beneficial composition may comprise a fatty acid. Suitable fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group. In a preferred embodiment, the fatty acid is dodecanoic acid (also known as coconut fatty acid).

The beneficial composition may also comprise a fragrance, a color care agent, a softening agent, an optical brightener, an enzyme, or a defoamer, as disclosed previously. The detergent composition may further comprise a soil releasing polymer, an anti-disposition agent, or a combination thereof. It may also comprise a whitening agent, a brightening agent, a color/texture rejuvenating agent, a bleaching catalyst, a bleaching agent, a bleach activator, a surfactant stabilizer, a builder, an enzyme, a dispersing agent, an anticorrosion agent, a deodorizing agent, a preservative, a bittering agent, and/or a biocidal agent.

According to a second aspect, the present disclosure provides a unit dose composition comprising a container and a liquid composition. The container may be a pouch or a pack (or pac) made from a water-soluble or water-dispersible polymer film, which encloses a liquid composition. The liquid composition consists of (i) a beneficial composition; and (ii) a solvent system. The solvent system consists of water, a single non-aqueous solvent (NAS), and a residual solvent present in an amount of 0 to 5% by weight of the liquid composition. The residual solvent is neither water nor the single NAS. Each of water and the NAS is present in an amount of more than 5% by weight of the liquid composition, with the solvent system totals from about 37.5% to about 80% by weight of the liquid composition.

In some embodiments according to the second aspect of the present invention, a unit dose pac is provided which includes a container formed from a water-soluble or water-dispersible film and a liquid composition entrapped in the container. The liquid composition consists of:

(1) a beneficial component comprising:

(i) an anionic surfactant selected from an alkyl ethoxylated sulphate (AES), an alkyl propoxy sulphate, an alkyl sulphate, a linear alkylbenzene sulfonic acid (LAS) or a salt thereof, or a mixture thereof; and preferably, selected from alkyl ethoxylated sulphate, in an amount of from about 2% to about 35% by weight of the liquid composition;

(ii) a non-ionic surfactant selected from alcohol ethoxylate, alcohol propoxylate, or a mixture thereof, in an amount of from about 2% to about 30% by weight of the liquid composition;

wherein the beneficial compositions contain no solvent;

(2) a solvent system consisting of water and a single non-aqueous solvent, and a residual solvent in an amount of less than 5% by weight of the liquid composition;

wherein the residual solvent is neither water nor the single non-aqueous solvent; wherein each of water and the single non-aqueous solvent is present in an amount of greater than 5% by weight of the liquid composition; and wherein the solvent system totals from about 37.5% to about 80% by weight of the liquid composition.

The components and amounts of the NAS, water, residual solvents, and beneficial composition can be substantially the same, as described earlier in this application, details of which will not be repeated.

EXAMPLES

Example 1

Preparation of Liquid Compositions Having 5% wt of Added Water

Liquid compositions were prepared by incorporating solvents, surfactants, polymers, enzymes, fragrances, and other functional materials commonly used in a finished detergent product, in accordance with Formulas A to E as shown in Table 1. Comparative Formulas A and B employed water and a traditional solvent, either glycerin (Gly) or propylene glycol (PG), to form a solvent system of unit dose pacs. Inventive Formulas C to E employed water and one of PEG 400, PEG 3350, and PEG 100 stearate, respectively, as solvents of unit dose pacs.

TABLE 1

| | % Activity | Water Content (% wt) | Formula A With Glycerin | B With PG | C With PEG 400 | D With PEG 3350 | E With PEG 100 Stearate |
|---|---|---|---|---|---|---|---|
| C12-C15 Alcohol Ethoxylate 7EO | 99.85 | 0.2 | 23.25 | 23.25 | 23.25 | 23.25 | 23.25 |
| Zeolite Water (added) | 100 | 100 | 5.00 | 5.00 | 5.00 | 5.00 | 5.00 |
| Optical Brightener | 100 | 0 | 0.30 | 0.30 | 0.30 | 0.30 | 0.30 |
| Triethanolamine | 85 | 15 | 0.90 | 0.90 | 0.90 | 0.90 | 0.90 |
| Bitrex | 25 | 0 | 0.05 | 0.05 | 0.05 | 0.05 | 0.05 |
| Sodium C12-C14 Alcohol Ethoxysulphate 3EO | 60 | 24.5 | 26.00 | 26.00 | 26.00 | 26.00 | 26.00 |
| 50% NaOH | 50 | 50 | 0.55 | 0.55 | 0.55 | 0.55 | 0.55 |
| Fatty Acids | 100 | 0 | 4.00 | 4.00 | 4.00 | 4.00 | 4.00 |
| IDS | 34 | 66 | 0.90 | 0.90 | 0.90 | 0.90 | 0.90 |
| Enzymes | about 8 | 50 | 2.55 | 2.55 | 2.55 | 2.55 | 2.55 |
| Other ingredient(s) | about 60 | 40 | 1.50 | 1.50 | 1.50 | 1.50 | 1.50 |
| Glycerin | 100 | 0 | 35.00 | 0 | 0 | 0 | 0 |
| Propylene Glycol | 100 | 0 | 0 | 35.00 | 0 | 0 | 0 |
| PEG 400 | 100 | 0 | 0 | 0 | 35.00 | 0 | 0 |
| PEG 3350 | 100 | 0 | 0 | 0 | 0 | 35.00 | 0 |
| PEG 100 Stearate | 100 | 0 | 0 | 0 | 0 | 0 | 35.00 |
| Total (% wt) | | | 100.00 | 100.00 | 100.00 | 100.00 | 100.00 |

Table 2 shows the solvent systems of Formulas A to E. There was a residual ethanol, derived from commercial AES, in an amount of 3.12% by weight of the liquid composition, in each solvent system. Though the added water was 5% by weight of the liquid composition in each formula of Table 1, the total water in each formula was 14.16% by weight of the liquid composition in each formula of Table 1 due to water contributed by the ingredients in the formula. The total solvent amount in each solvent system is 52.28% by weight of the liquid composition.

TABLE 2

| | Comparative Formula A | B | Inventive Formula C | D | E |
|---|---|---|---|---|---|
| | | | NAS | | |
| | Glycerin | PG | PEG 400 | PEG 3350 | PEG 100 Stearate |
| Approx. total water (% wt) | 14.16 | 14.16 | 14.16 | 14.16 | 14.16 |
| Approx. total NAS (% wt) | 35.00 | 35.00 | 35.00 | 35.00 | 35.00 |

TABLE 2-continued

| | Comparative Formula A | B | Inventive Formula C | D | E |
|---|---|---|---|---|---|
| | | | NAS | | |
| | Glycerin | PG | PEG 400 | PEG 3350 | PEG 100 Stearate |
| Approx. total ethanol from AES (% wt) | 3.12 | 3.12 | 3.12 | 3.12 | 3.12 |
| Approx. Total Solvent (% wt) | 52.28 | 52.28 | 52.28 | 52.28 | 52.28 |

Example 2

Preparation of Liquid Compositions Having 10% wt of Added Water

Liquid compositions were prepared by incorporating solvents, surfactants, polymers, enzymes, fragrances, and other functional materials commonly used in a finished detergent product, in accordance with Formulas F to J as shown in Table 3. Comparative Formulas F and G employed water and a traditional solvent, either glycerin or propylene glycol, to form a solvent system of unit dose pacs. Inventive Formulas H to J employed water and one of PEG 400, PEG 3350, and PEG 100 stearate, respectively, as solvents of unit dose pacs.

TABLE 3

| | % Activity | Water Content (% wt) | Formula F With Glycerin | G With PG | H With PEG 400 | I With PEG 3350 | J With PEG 100 Stearate |
|---|---|---|---|---|---|---|---|
| C12-C15 Alcohol Ethoxylate 7EO | 99.85 | 0.2 | 23.25 | 23.25 | 23.25 | 23.25 | 23.25 |
| Zeolite Water (added) | 100 | 100 | 10.00 | 10.00 | 10.00 | 10.00 | 10.00 |
| Optical Brightener | 100 | 0 | 0.30 | 0.30 | 0.30 | 0.30 | 0.30 |

TABLE 3-continued

| | % Activity | Water Content (% wt) | Formula F With Glycerin | G With PG | H With PEG 400 | I With PEG 3350 | J With PEG 100 Stearate |
|---|---|---|---|---|---|---|---|
| Triethanolamine | 85 | 15 | 0.90 | 0.90 | 0.90 | 0.90 | 0.90 |
| Bitrex | 25 | 0 | 0.05 | 0.05 | 0.05 | 0.05 | 0.05 |
| Sodium C12-C14 Alcohol Ethoxysulphate 3EO | 60 | 24.5 | 26.00 | 26.00 | 26.00 | 26.00 | 26.00 |
| 50% NaOH | 50 | 50 | 0.55 | 0.55 | 0.55 | 0.55 | 0.55 |
| Fatty Acids | 100 | 0 | 4.00 | 4.00 | 4.00 | 4.00 | 4.00 |
| IDS | 34 | 66 | 0.90 | 0.90 | 0.90 | 0.90 | 0.90 |
| Enzymes | about 8 | 50 | 2.55 | 2.55 | 2.55 | 2.55 | 2.55 |
| Other ingredient(s) | about 60 | 40 | 1.50 | 1.50 | 1.50 | 1.50 | 1.50 |
| Glycerin | 100 | 0 | 30.00 | 0 | 0 | 0 | 0 |
| Propylene Glycol | 100 | 0 | 0 | 30.00 | 0 | 0 | 0 |
| PEG 400 | 100 | 0 | 0 | 0 | 30.00 | 0 | 0 |
| PEG 3350 | 100 | 0 | 0 | 0 | 0 | 30.00 | 0 |
| PEG 100 Stearate | 100 | 0 | 0 | 0 | 0 | 0 | 30.00 |
| Total (% wt) | | | 100.00 | 100.00 | 100.00 | 100.00 | 100.00 |

Table 4 shows the solvent systems of Formulas F to J. There was a residual ethanol, derived from commercial AES, in a net amount of 3.12% by weight of the liquid composition, in each solvent system. Though the added water was 10% by weight of the liquid composition in each formula of Table 1, the total water in each formula was 19.16% by weight of the liquid composition in each formula of Table 4 due to water contributed by other ingredients in the formula. The total solvent amount in each solvent system is 52.28% by weight of the liquid composition.

TABLE 4

| | Comparative Formula F | G | Inventive Formula H | I | J |
|---|---|---|---|---|---|
| | NAS | | | | |
| | Glycerin | PG | PEG 400 | PEG 3350 | PEG 100 Stearate |
| Approx. total water (% wt) | 19.16 | 19.16 | 19.16 | 19.16 | 19.16 |
| Approx. total NAS (% wt) | 30.00 | 30.00 | 30.00 | 30.00 | 30.00 |

TABLE 4-continued

| | Comparative Formula F | G | Inventive Formula H | I | J |
|---|---|---|---|---|---|
| | NAS | | | | |
| | Glycerin | PG | PEG 400 | PEG 3350 | PEG 100 Stearate |
| Approx. total ethanol from AES (% wt) | 3.12 | 3.12 | 3.12 | 3.12 | 3.12 |
| Approx. Total Solvent (% wt) | 52.28 | 52.28 | 52.28 | 52.28 | 52.28 |

Example 3

Preparation of Liquid Compositions Having 15% wt of Added Water

Liquid compositions were prepared by incorporating solvents, surfactants, polymers, enzymes, fragrances, and other functional materials commonly used in a finished detergent product, in accordance with Formulas K to O as shown in Table 5. Comparative Formulas K and L employed water and a traditional solvent, either glycerin or propylene glycol, to form the solvent system in the unit dose pacs. Inventive Formulas M to O employed water and one of PEG 400, PEG 3350, and PEG 100 stearate, respectively, as solvents in the unit dose pacs.

TABLE 5

| | % Activity | Water Content (% wt) | Formula K With Glycerin | L With PG | M With PEG 400 | N With PEG 3350 | O With PEG 100 Stearate |
|---|---|---|---|---|---|---|---|
| C12-C15 Alcohol Ethoxylate 7EO | 99.85 | 0.2 | 23.25 | 23.25 | 23.25 | 23.25 | 23.25 |
| Zeolite Water (added) | 100 | 100 | 15.00 | 15.00 | 15.00 | 15.00 | 15.00 |
| Optical Brightener | 100 | 0 | 0.30 | 0.30 | 0.30 | 0.30 | 0.30 |
| Triethanolamine | 85 | 15 | 0.90 | 0.90 | 0.90 | 0.90 | 0.90 |

TABLE 5-continued

| | % Activity | Water Content (% wt) | Formula K With Glycerin | L With PG | M With PEG 400 | N With PEG 3350 | O With PEG 100 Stearate |
|---|---|---|---|---|---|---|---|
| Bitrex | 25 | 0 | 0.05 | 0.05 | 0.05 | 0.05 | 0.05 |
| Sodium C12-C14 Alcohol Ethoxysulphate 3EO | 60 | 24.5 | 26.00 | 26.00 | 26.00 | 26.00 | 26.00 |
| 50% NaOH | 50 | 50 | 0.55 | 0.55 | 0.55 | 0.55 | 0.55 |
| Fatty Acids | 100 | 0 | 4.00 | 4.00 | 4.00 | 4.00 | 4.00 |
| IDS | 34 | 66 | 0.90 | 0.90 | 0.90 | 0.90 | 0.90 |
| Enzymes | about 8 | 50 | 2.55 | 2.55 | 2.55 | 2.55 | 2.55 |
| Other ingredient(s) | about 60 | 40 | 1.50 | 1.50 | 1.50 | 1.50 | 1.50 |
| Glycerin | 100 | 0 | 25.00 | 0 | 0 | 0 | 0 |
| Propylene Glycol | 100 | 0 | 0 | 25.00 | 0 | 0 | 0 |
| PEG 400 | 100 | 0 | 0 | 0 | 25.00 | 0 | 0 |
| PEG 3350 | 100 | 0 | 0 | 0 | 0 | 25.00 | 0 |
| PEG 100 Stearate | 100 | 0 | 0 | 0 | 0 | 0 | 25.00 |
| Total (% wt) | | | 100.00 | 100.00 | 100.00 | 100.00 | 100.00 |

Table 6 shows the solvent systems of Formulas K to O. There was a residual ethanol, derived from commercial AES, in an amount of 3.12% by weight of the liquid composition, in each solvent system. Though the added water was 15% by weight of the liquid composition in each formula of Table 1, the total water in each formula was 24.16% by weight of the liquid composition in each formula of Table 4 due to water contributed by other ingredients in the formula. The total solvent amount in each solvent system is 52.28% by weight of the liquid composition.

TABLE 6

| | Comparative Formula K | L | Inventive Formula M | N | O |
|---|---|---|---|---|---|
| | NAS | | | | |
| | Glycerin | PG | PEG 400 | PEG 3350 | PEG 100 Stearate |
| Approx. total water (% wt) | 24.16 | 24.16 | 24.16 | 24.16 | 24.16 |
| Approx. total NAS (% wt) | 25.00 | 25.00 | 25.00 | 25.00 | 25.00 |
| Approx. total ethanol from AES (% wt) | 3.12 | 3.12 | 3.12 | 3.12 | 3.12 |
| Approx. Total Solvent (% wt) | 52.28 | 52.28 | 52.28 | 52.28 | 52.28 |

Example 4

Unit Dosc Pac Preparation and Pac Stability Study

The liquid compositions prepared in accordance with Formulas A to O were batched and placed into 20 gram single chamber pacs using GS-75 film (from Aicello), according to a conventional unit dose preparation method. The pacs were then aged for 1 hour at 25° C. at about 40% Relative Humidity ("RH") and measured for stability defined by pac haptics (e.g., measuring the pac height and pac length and observing the general appearance of each pac).

Height of the single dose pac was measured by Ames® Logic Basic Digital Comparator on a column mounted indicator. Height of the sample was measured by placing the single dose pac under the digital indicator, after the scale was zeroed. Pac length was measured by placing pac on a flat surface and measuring the length of the pac to flat surface contact length of the smaller side (i.e., the 1.3 inch side of an 1.3 by 1.7 inch pac). Distance was measured by a caliper such as General Ultratech caliper. The measured results and other observations were reported in Table 7.

TABLE 7

| Formula | Added Water | NAS | Pac Height (inches) at 1 hr, 25° C. | Pac Length (inches) at 1 hr, 25° C. | Notes |
|---|---|---|---|---|---|
| A | 5% wt | Glycerin | 0.80 | 1.37 | Liquid Stable |
| B | | PG | 0.74 | 1.05 | Liquid Stable |
| C | | PEG 400 | 0.82 | 0.59 | Liquid Stable |
| D | | PEG 3350 | — | — | Liquid Precipitated |
| E | | PEG 100 Stearate | — | — | Liquid Precipitated |
| F | 10% wt | Glycerin | 0.75 | 1.22 | Liquid Stable |
| G | | PG | 0.74 | 1.03 | Liquid Stable |
| H | | PEG 400 | 0.82 | 0.58 | Liquid Stable |
| I | | PEG 3350 | — | — | Liquid Precipitated |
| J | | PEG 100 Stearate | — | — | Liquid Precipitated |
| K | 15% wt | Glycerin | 0.75 | 1.10 | Liquid Stable |
| L | | PG | 0.74 | 1.04 | Liquid Stable |
| M | | PEG 400 | 0.82 | 0.45 | Liquid Stable |
| N | | PEG 3350 | 0.82 | 0.44 | Liquid Stable |
| O | | PEG 100 Stearate | 0.82 | 0.30 | Liquid Stable |

A pac height of 0.82 inch is considered a maximum score. Table 7 clearly shows that unit dose pacs encapsulated the inventive formulas are more rigid and stable, compared to unit doses encapsulated the comparative (conventional) formulas.

At the 5% added water bracket, inventive Formula C (PEG 400) outperformed comparative Formulas A (glycerin) and B (PG) for pac height, but the difference in stability was more pronounced in the pac contact length measurement, indicating that unit dose pacs encapsulating inventive Formula C were much more stable than unit dose pacs encapsulating comparative Formulas A and B. Table 7 shows the detriment of higher molecular weight materials (e.g., PEG 3350 and PEG 100 Stearate) at this water level. PEG 3350 and PEG 100 Stearate were not able to exist as a liquid phase and crystallized out within 24 hours.

At the 10% added water bracket, inventive Formula H (PEG 400) outperformed comparative Formulas F (Glycerin) and G (PG) for pac height, but the difference in stability was more pronounced in the pac contact length measurement, indicating that unit dose pacs encapsulating inventive Formula H were much more stable than unit dose pacs encapsulating comparative Formulas F and G. Table 7 also shows the detriment of higher molecular weight materials at this water level. PEG 3350 and PEG 100 Stearate were not able to exist as a liquid phase and crystallized out within 24 hours.

At the 15% added water bracket, inventive Formulas M (PEG 400), N (PEG 3350), and O (PEG 100 Stearate) outperformed comparative Formulas K (Glycerin) and L (PG) for pac height, but the difference in stability was more pronounced in the pac contact length measurement, indicating that unit dose pacs encapsulating inventive Formulas M, N, and O were much more stable than unit dose pacs encapsulating comparative Formulas K and L. Table 7 also shows that the threshold of water needed to keep higher molecular weight materials as liquid was surpassed. PEG 3350 and PEG 100 Stearate became suitable solvents that outperformed PG and Gly at this water level.

Example 5

Unit Dosc Pac Preparation and Extensive Pac Stability Study

Liquid compositions having Formulas P to X were prepared following the procedures of Examples 1-3. Formulas P to X differ from the formulas in the previous examples in that Formulas P to Q include 4.00% wt of added water and one of 41.04% wt of PEG 400, glycerin, propylene glycol, respectively; Formulas S to U include 12.21% wt of added water and one of 32.83% wt of PEG 400, glycerin, propylene glycol, respectively; and Formulas V to W include 20.42% wt of added water and one of 24.62% wt of PEG 400, glycerin, propylene glycol, respectively. The added water amount and the NAS (e.g., PEG 400, glycerin, propylene glycol) of Formulas P to X are displayed in the left columns of Table 8.

The total water in each of Formulas P to X was more than the added water due to additional water (approximately 9% wt) contributed by other ingredients in the formulas. Additionally, there was a residual ethanol, derived from AES, in an amount of 3.12% by weight of the liquid composition, in each solvent system.

Table 8 illustrates premium-level detergent compositions (i.e. with a high active surfactant, polymers, enzymes, optical brighteners, etc.) with varying amounts of water (about 4 to 20% wt added water) as well as the use of a single NAS: glycerin, propylene glycol, or PEG 400. The added water and single NAS totals about 45% of the composition, with approximately 55% being the active raw materials.

TABLE 8

| Formula | Added Water | NAS | 2 wk RT Dissolution (sec) | 4 wk 105° F. Dissolution (sec) | 2 wk RT Pac Height (inch) | 4 wk 105° F. Pac Height (inch) | % Weight Loss |
|---|---|---|---|---|---|---|---|
| P (Inventive) | 4.00 % wt | PEG 400, at 41.04 % wt | 342 | 361 | 0.82 | 0.82 | 3.67 |
| Q (Comparative) | | GLY, at 41.04 % wt | 304 | 439 | 0.75 | 0.61 | −2.28 |
| R (Comparative) | | PG, at 41.04 % wt | 260 | 327 | 0.82 | 0.81 | 2.06 |
| S (Inventive) | 12.21 % wt | PEG 400, at 32.83 % wt | 380 | 439 | 0.82 | 0.82 | 6.48 |
| T (Comparative) | | GLY, at 32.83 % wt | 367 | 582 | 0.70 | 0.62 | 4.49 |
| U (Comparative) | | PG, at 41.04 % wt | 313 | 719 | 0.79 | 0.77 | 3.88 |
| V (Inventive) | 20.42 % wt | PEG 400, at 24.62 % wt | 367 | 473 | 0.82 | 0.78 | 2.67 |
| W (Comparative) | | GLY, at 24.62 % wt | 518 | 972 | 0.60 | 0.56 | 9.10 |
| X (Comparative) | | PG, at 24.62 % wt | 544 | 1380 | 0.66 | 0.68 | 5.98 |

Table 9 illustrates the base that the solvent system of Table 8 were added to in order to make the final compositions in the unit dose pacs. The pH ranges of the final compositions are from 7.2 to 8.3.

TABLE 9

| Components | % wt |
|---|---|
| C12-C15 Alcohol Ethoxylate 7EO | 23.07 |
| Sodium C12-C14 Alcohol Ethoxysulphate 3EO | 22.36 |
| Neutralizers/Bittering Agents/ Optical Brigheter/Polymers | 3.93 |
| Coconut Fatty Acid | 4.00 |
| Enzymes | 1.60 |

The compositions in the above tables were placed into 20 gram, single chamber pacs with M8312 film and then aged appropriately. Pac height, pac length, pac dissolution, and percent weight loss after storage were measured and the results were reported in Table 8.

Pac height and pac length were measured by the methods as described in Example 4.

"Dissolution" as used herein refers to time required for a pac to dissolve in water. Dissolution was determined by measuring the time for a pac to dissolve in 1 liter of 10 C water of a NE6-COP by Copley (a tergetomer). Dissolution is generally desirable to have values of less than 720 seconds, preferably less than 550 seconds, most preferably less than 400 seconds. Higher dissolution times means that it will take longer for the detergent solution to be released from the pac, which will likely lead to less effective cleaning since there is a lower residence time for available for the textiles to be in the presence of the detergent. Thus, ideally the unit dose pacs prepared with an inventive formula have a dissolution rate which is lower than the unit dose pacs prepared with a conventional liquid composition.

Percent (%) weight loss was determined by measuring the pac right after manufacture and then again after aging at a specific temperature for a set amount of time. A simple lab scale was used to measure the mass. In this case, % weight loss was measured after stored for 1 hour at 75° F. and 50% RH (relative humidity) and then aged for 4 weeks at 105° F. and 50% RH. After 4 weeks of aging at 105° F. and 50% RH, it is preferable for weight loss to be less than 6%, more preferable, less than 4%, most preferable less than 2%. The higher % weight loss means that the unit dose pac is less stable.

Table 8 shows that in the 4% wt of added water bracket, inventive Formula P outperformed comparative Formula Q (Glycerin) for pac height and performed similarly to comparative Formula R (PG).

In the about 12% wt of added water bracket, inventive Formula S outperformed both comparative Formulas T (Glycerin) and U (PG) for pac height and dissolution after aging at 105° F. for 4 weeks.

In the about 20% wt of added water bracket, inventive Formula V outperformed both comparative Formulas W (Glycerin) and X (PG) even more significantly for pac height, dissolution after aging at 75° F. and 105° F. for 4 weeks as well as % Weight Loss.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing Detailed Description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pac comprising:

a container formed from a water-soluble or water-dispersible film; and a liquid composition entrapped in the container, wherein the liquid composition is free of glycerin, propylene glycol and polyethylene glycol having a weight average molecular weight of about 400 g/mol and comprises:

(a) a beneficial composition comprising a C12-C14 alkyl ethoxylated sulphate in an amount of from about 8% to about 20% actives by weight of the liquid composition, and a C12-C15 alcohol ethoxylate in an amount of from about 20% to about 25% by weight of the liquid composition; and (b) a solvent system comprising water in an amount of 24 to 25% by weight of the liquid composition, a single non-aqueous solvent selected from the group consisting of polyethylene glycol having a weight average molecular weight of about 3350 g/mol and polyethylene glycol 100 stearate and present in an amount of 25% by weight of the liquid composition, and a residual solvent comprising ethanol in an amount of from 0 to 5% by weight of the liquid composition.

2. The unit dose pac of claim 1, wherein the non-aqueous solvent is polyethylene glycol having a weight average molecular weight of about 3350 g/mol.

3. The unit dose pac of claim 1, wherein the non-aqueous solvent is PEG 100 stearate.

4. The unit dose pac of claim 1, wherein the ethanol is present in an amount of about 3% by weight of the liquid composition.

5. The unit dose pac of claim 1 wherein the C12-C14 alkyl ethoxylated sulphate is further defined as $CH_3(CH_2)_{10-12}CH_2(OCH_2CH_2)_3OSO_3Na$.

6. The unit dose pac of claim 5 wherein the C12-C14 alkyl ethoxylated sulphate is present in an amount of about 15% to about 16% actives by weight of the liquid composition.

7. The unit dose pac of claim 1 wherein the C12-C14 alkyl ethoxylated sulphate is present in an amount of about 15% to about 16% actives by weight of the liquid composition.

8. The unit dose pac of claim 1 wherein the C12-C15 alcohol ethoxylate is further defined as C12-C15 alcohol ethoxylate 7 EO.

9. The unit dose pac of claim 8 wherein the C12-C15 alcohol ethoxylate is present in an amount of about 23% by weight of the liquid composition.

10. The unit dose pac of claim 1 wherein the C12-C15 alcohol ethoxylate is present in an amount of about 23% by weight of the liquid composition.

11. The unit dose pac of claim 1 wherein the C12-C14 alkyl ethoxylated sulphate is further defined as $CH_3(CH_2)_{10-12}CH_2(OCH_2CH_2)_3OSO_3NA$;

the C12-C14 alkyl ethoxylated sulphate is present in an amount of about 15% to about 16% actives by weight of the liquid composition;

the C12-C15 alcohol ethoxylate is further defined as C12-C15 alcohol ethoxylate 7 EO; and the C12-C15 alcohol ethoxylate is present in an amount of about 23% by weight of the liquid composition.

12. The unit dose pac of claim 11 wherein the ethanol is present in an amount of about 3% by weight of the liquid composition.

13. The unit dose pac of claim 11 wherein the solvent system consists of the water, the single non-aqueous solvent, and the residual solvent.

14. The unit dose pac of claim 13, wherein the is ethanol is present in an amount of about 3% by weight of the liquid composition.

15. The unit dose pac of claim 14, wherein the non-aqueous solvent is PEG 100 stearate.

16. The unit dose pac of claim 14, wherein the non-aqueous solvent is polyethylene glycol having a weight average molecular weight of about 3350 g/mol.

17. The unit dose pac of claim 1 wherein the solvent system consists of the water, the single non-aqueous solvent, and the residual solvent.

18. The unit dose pac of claim 17, wherein the is ethanol is present in an amount of about 3% by weight of the liquid composition.

19. The unit dose pac of claim 18, wherein the non-aqueous solvent is PEG 100 stearate.

20. The unit dose pac of claim 18, wherein the non-aqueous solvent is polyethylene glycol having a weight average molecular weight of about 3350 g/mol.

* * * * *